US007155796B2

(12) United States Patent
Cook

(10) Patent No.: US 7,155,796 B2
(45) Date of Patent: Jan. 2, 2007

(54) METHOD FOR ASSEMBLING A MODULAR SPORTS FIELD

(75) Inventor: Charles Cook, Rochester, MI (US)

(73) Assignee: GeneralSports Turf, LLC, Rochester, MI (US)

( * ) Notice: Subject to any disclaimer, the term of this patent is extended or adjusted under 35 U.S.C. 154(b) by 363 days.

(21) Appl. No.: 10/709,206

(22) Filed: Apr. 21, 2004

(65) Prior Publication Data

US 2005/0158482 A1 Jul. 21, 2005

Related U.S. Application Data

(60) Provisional application No. 60/537,754, filed on Jan. 20, 2004.

(51) Int. Cl.
*B32B 3/00* (2006.01)
*A63B 71/00* (2006.01)

(52) U.S. Cl. ..... 29/428; 29/445; 29/469; 29/525.01; 29/525.02; 428/17; 428/95

(58) Field of Classification Search ..... 29/897, 29/445, 428, 469, 525.01, 525.02, 799; 428/17, 428/87, 95
See application file for complete search history.

(56) References Cited

U.S. PATENT DOCUMENTS 3,513,062 A * 5/1970 Vinicki ..... 428/17
3,661,687 A * 5/1972 Spinney et al. ..... 428/17
3,735,988 A * 5/1973 Palmer et al. ..... 473/162
3,935,352 A * 1/1976 Toland ..... 428/95
3,995,079 A 11/1976 Haas, Jr.
4,061,804 A * 12/1977 McCulloch ..... 428/17
4,389,435 A 6/1983 Haas, Jr.
4,571,353 A * 2/1986 Gable, Jr. ..... 428/33
4,637,942 A * 1/1987 Tomarin ..... 428/17
4,755,401 A * 7/1988 Friedrich et al. ..... 428/17
5,082,712 A * 1/1992 Starp ..... 428/95
5,292,130 A * 3/1994 Hooper ..... 473/279
5,309,846 A * 5/1994 Peterson ..... 108/53.3
5,595,021 A * 1/1997 Ripley et al. ..... 47/66.5
5,673,513 A * 10/1997 Casimaty ..... 47/65.9
5,958,527 A * 9/1999 Prevost ..... 428/17
6,263,616 B1 * 7/2001 Hummer ..... 47/65.9
6,338,885 B1 1/2002 Prevost
6,723,413 B1 * 4/2004 Walters ..... 428/95
6,740,387 B1 * 5/2004 Lemieux ..... 428/95
6,767,595 B1 * 7/2004 Prevost et al. ..... 428/17
2002/0136846 A1 * 9/2002 Prevost ..... 428/17
2003/0118755 A1 * 6/2003 Motz et al. ..... 428/17
2004/0058096 A1 * 3/2004 Prevost ..... 428/17
2004/0081771 A1 * 4/2004 Waterford ..... 428/17

* cited by examiner

*Primary Examiner*—Jermie E. Cozart

(57) ABSTRACT

A modular synthetic grass playing surface system formed from a plurality of modular units. Each modular unit has a synthetic grass layer placed upon predetermined sized pallets having a pre-installed elastomeric layer. A layer of resilient particle infill is optionally introduced to the top surface of the modular unit. A corrugated plastic sleeve is optionally installed around each formed modular unit while the modular unit is stored and moved. A plurality of modular units are then installed onto a relatively flat surface to form the playing surface in a desired shape and size.

20 Claims, 5 Drawing Sheets

METHOD FOR ASSEMBLING A MODULAR SPORTS FIELD

BACKGROUND OF INVENTION

The present invention relates generally to synthetic sports fields and more specifically to a modular indoor/outdoor synthetic sports turf.

Synthetic grass sports surfaces are well known. These surfaces are becoming increasingly popular as replacements for natural grass surfaces in stadiums, playgrounds, golf driving ranges, and other facilities where natural grass is typically utilized. The synthetic grass surfaces stand up to wear much better than the natural grass surfaces, do not require as much maintenance, and can be used in partially or fully enclosed stadiums where natural grass cannot typically be grown.

Most synthetic grass surfaces comprise rows of strips or ribbons of synthetic grass-like material, extending vertically from a backing mat with particulate material infill in between the ribbons on the mat. One or more layers of aggregate material are typically introduced between the backing mat and on top of a smoothed and compacted subgrade. The surfaces are preferably crowned to promote water drainage.

The ribbons of synthetic grass-like material usually extend a short distance above the layer of particulate material and represent blades of grass. The length of these fibers is dictated by the end use of the playing surface. For example, football fields utilize fibers that are longer than golf driving range surfaces.

The particulate material usually comprises sand, as shown by way of example in U.S. Pat. No. 3,995,079 and U.S. Pat. No. 4,389,435, both to Haas, Jr. The particulate matter can also comprise a mixture of sand and other materials, including rubber infill, as shown, for example, in U.S. Pat. No. 6,338,885 to Prevost. In these systems, the rubber infill and sand together provide resiliency to the synthetic grass surfaces. In addition, the sand particles add weight to hold down the backing material, thus helping to ensure that the strips of synthetic grass do not move or shift during play.

While the growth of synthetic grass surfaces has grown exponentially over the past quarter century, the technology used in forming the grass surfaces and laying the synthetic fields is still relatively new. For example, there is no current technology available for easily installing and subsequently removing the synthetic grass surfaces for indoor multipurpose stadiums that utilize the arenas for substantially different sporting events and concerts.

To install a typical indoor synthetic grass field, strips of synthetic turf are unrolled and aligned on the floor or onto a level subgrade previously installed over the floor. Each strip of turf is then sewn together to the next adjacent strip(s) to ensure that no gaps exist between the strips. A layer of infill is then introduced over the strips of turf, leveled and groomed. This process is time consuming and labor intensive.

To remove the field, the infill must first be removed. The process of removing the infill is tedious and inefficient, as millions of small particles of sand and/or rubber are difficult to pick up and remove. Next, the strips must be removed one at a time. To accomplish this, the seams must be cut or otherwise un-sewn. The strips must then be re-rolled and removed. Finally, if a level subgrade is added over the flooring, it must also be removed. As such, the indoor venue may not be ready for other events for several days.

Because of the time and expense in removing these indoor synthetic fields, it is more likely that the fields will remain in place while other events within the venue are staged. For example, in late 2003, Ford Field in Detroit, Mich. staged a collegiate basketball game between Michigan State University and the University of Kentucky. In this game, a basketball floor was installed over the synthetic grass surface, rather than removing the grass surface, a process that was potentially damaging to the underlying grass surface.

It is thus highly desirable to produce a synthetic grass surface having desired playability while being easy to install and remove that is especially ideal for use in indoor multipurpose sporting arenas.

SUMMARY OF INVENTION

The present invention is directed to a modular synthetic grass surface that can be used in all types of end use applications. The present invention is also directed at a method for installing and removing the playing field utilizing this modular concept.

The present invention discloses a modular synthetic grass playing surface system formed from a plurality of modular synthetic grass units. Each modular synthetic grass unit has a synthetic grass layer placed upon predetermined sized pallets having a pre-installed elastomeric layer. A layer of resilient particles, preferably cryogenic or ambiently ground rubber infill particles, may optionally be introduced to the top surface of the modular unit, depending upon the characteristics of the synthetic grass layer. A corrugated plastic sleeve is installed around each formed modular unit having a resilient particle infill while the modular unit is stored and moved.

A plurality of modular units, having the optional corrugated plastic sheet removed, are then installed onto a relatively flat surface to form the playing surface in a desired shape and size. The installation of each modular unit is accomplished by using forklifts or other suitable equipment to move the modular units to the desired location to form the synthetic grass playing surface. The modular units are then preferably fastened together to form, the larger field surface.

To remove the field, the forklift simply removes each of the modular units one at a time. The corrugated plastic sheet is reinstalled to ensure that the rubber infill remains on the top surface of the modular unit when the unit is stored for subsequent use.

The present invention thus allows synthetic turf fields to be easily installed and removed in a fraction of the time and expense typically need in prior art synthetic surfaces as described above. The present invention also forms a field that can be easily stored in efficient and space-limiting manner.

Other objects and advantages of the present invention will become apparent upon considering the following detailed description and appended claims, and upon reference to the accompanying drawings.

DETAILED DESCRIPTION

Figure 1:
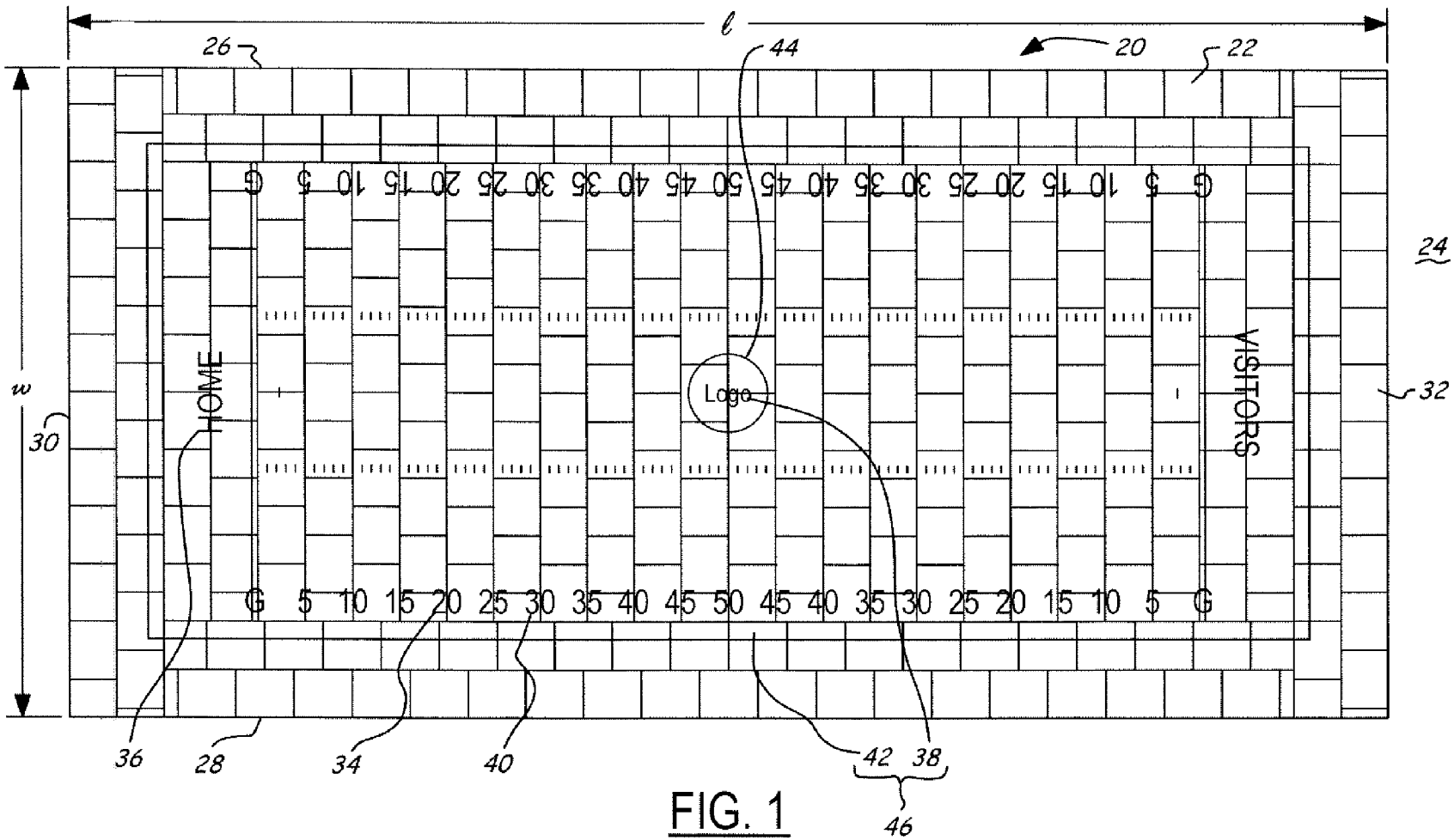
FIG. 1 is a top view of a sports playing surface formed from synthetic grass modular units in accordance with one embodiment of the present invention.

FIG. 1 illustrates a top view of sports playing surface 20, here a football field, according to one embodiment of the present invention. The surface 20 has two or more synthetic grass modular units 22 placed in a desired configuration onto the floor of a sports facility 24, preferably an indoor stadium. However, the sports playing surface 20 can be utilized at any sports facility. The number of units 22 is determined by the overall width (w) of the field 20 extending from a first lengthwise side 26 to a second lengthwise side 28 (shown as the left side and right side respectively on FIG. 1) and by the overall length (l) of the field 20 extending from a first widthwise side 30 to a second widthwise side 32.

The playing surface 20 may have a series of numbers 34, letters 36, logos 38, yard lines 40, sideline markings 42 and/or other markings 44 (collectively features 46), preferably inlaid or stenciled, within or on the surface of one or more modular units 22.

Figure 2:
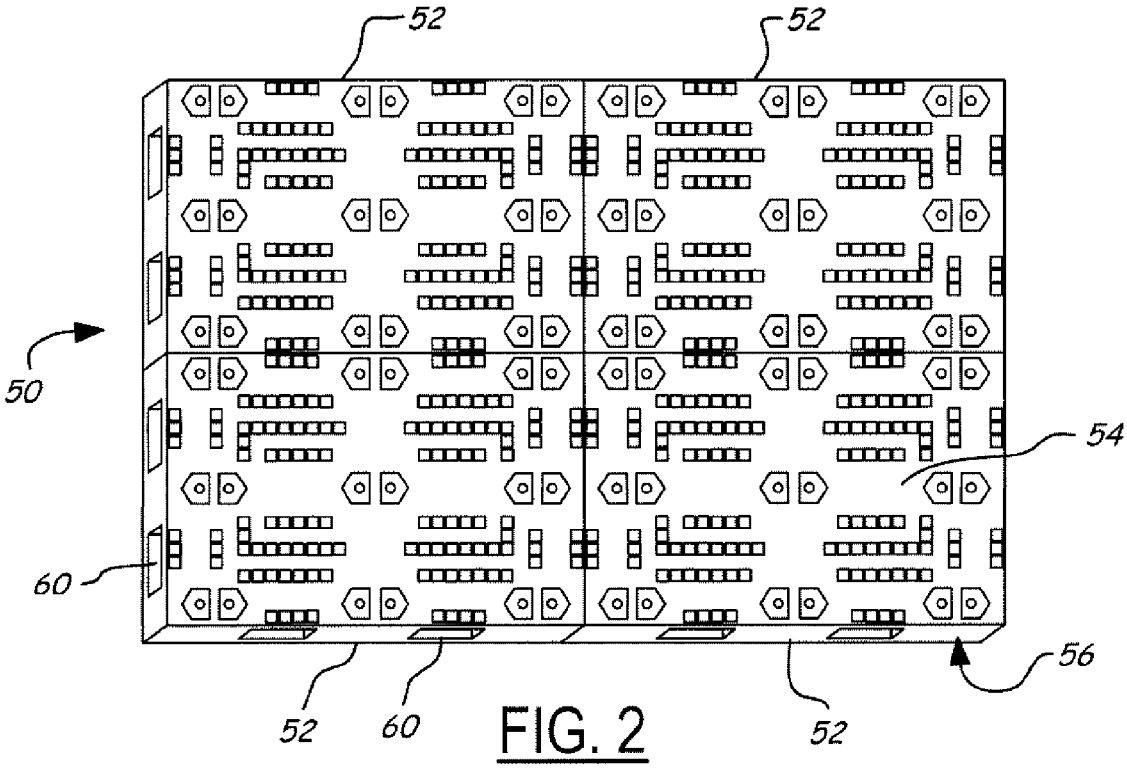
FIG. 2 illustrates a top view of a portion of the of FIG. 1.

As best shown in FIG. 2, each modular unit 22 has a rectangular or square-shaped base structure 50 consisting of a series of two or more smaller pallets 52 fastened together. In the embodiment as shown in FIG. 2, the modular unit 22 is formed of four smaller pallets 52 fastened together. Each pallet 52, in its preferred configuration, is approximately four feet wide by six feet long and about 5–8 inches in height. The pallet 52 is fully reversible, in which the top surface 54 and bottom surface 56 are flat and able to receive the subsequently laid playing surface (shown as 64 in FIG. 3). The pallets 52 are also stackable. Each pallet 52 is preferably pre-drilled with a 7/16 inch drill at all corners and centered on the widthwise side (i.e. at about 2 feet from each corner). Each side of the pallet 52 has openings 60 through which the forks of a forklift may be introduced. One pallet 52 currently manufactured that meets these desired requirements is Orvis' 48-inch by 72-inch pallets. The pallets 52 are then fastened together with 3/8-inch all-thread rods with coarse-thread hex nuts and with 5/16-inch washers on top and bottom. In the embodiment described in FIG. 2, the modular unit 22 weighs approximately 440 pounds and has about 96.5 square feet along the top playing surface 64. Further, where modular units 22 are formed from two base structures that are 8 feet wide by 18 feet long, a 3.5 inch by 1 inch C-channel (not shown) is formed through the center of the unit 22 (i.e. between base structures 50) for stabilization purposes. It will be understood that the modular units 22 can take on a variety of other sizes and shapes.

Figure 3:
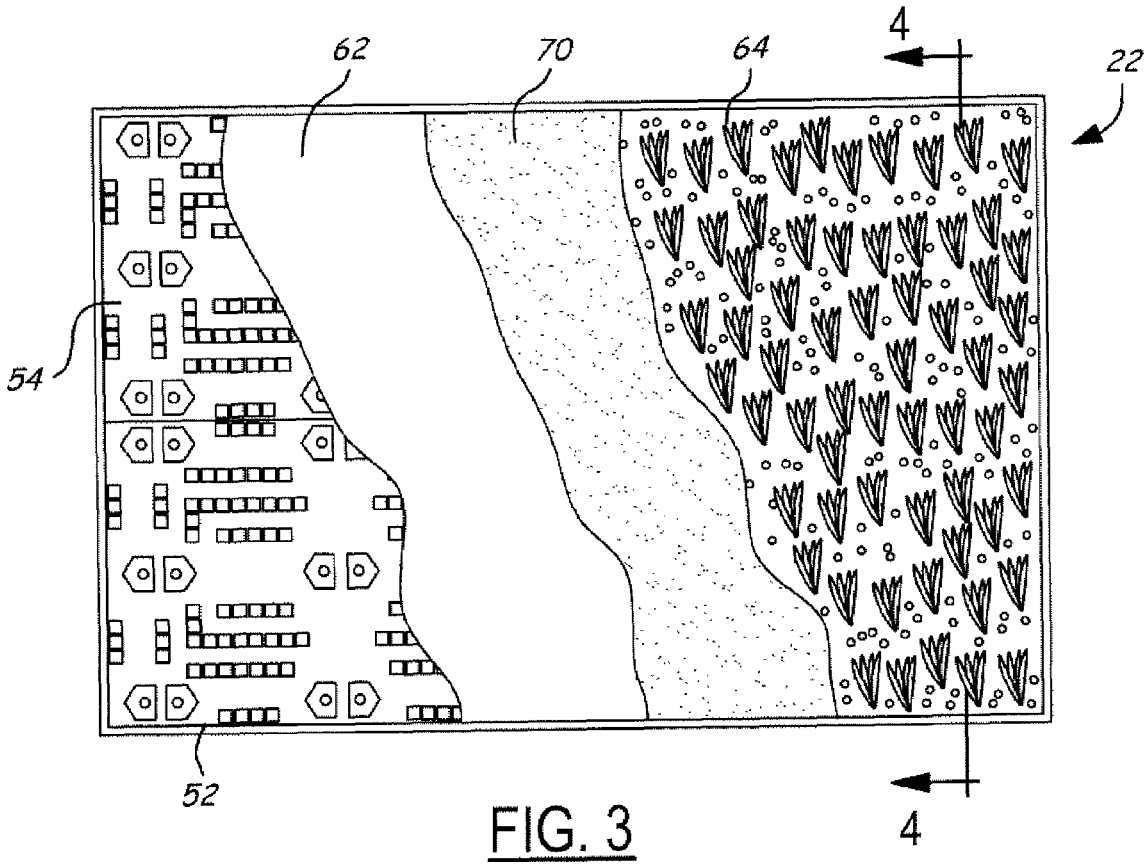
FIG. 3 illustrates a top partially sectioned view of the modular unit of FIGS. 1 and 2.
Figure 4:
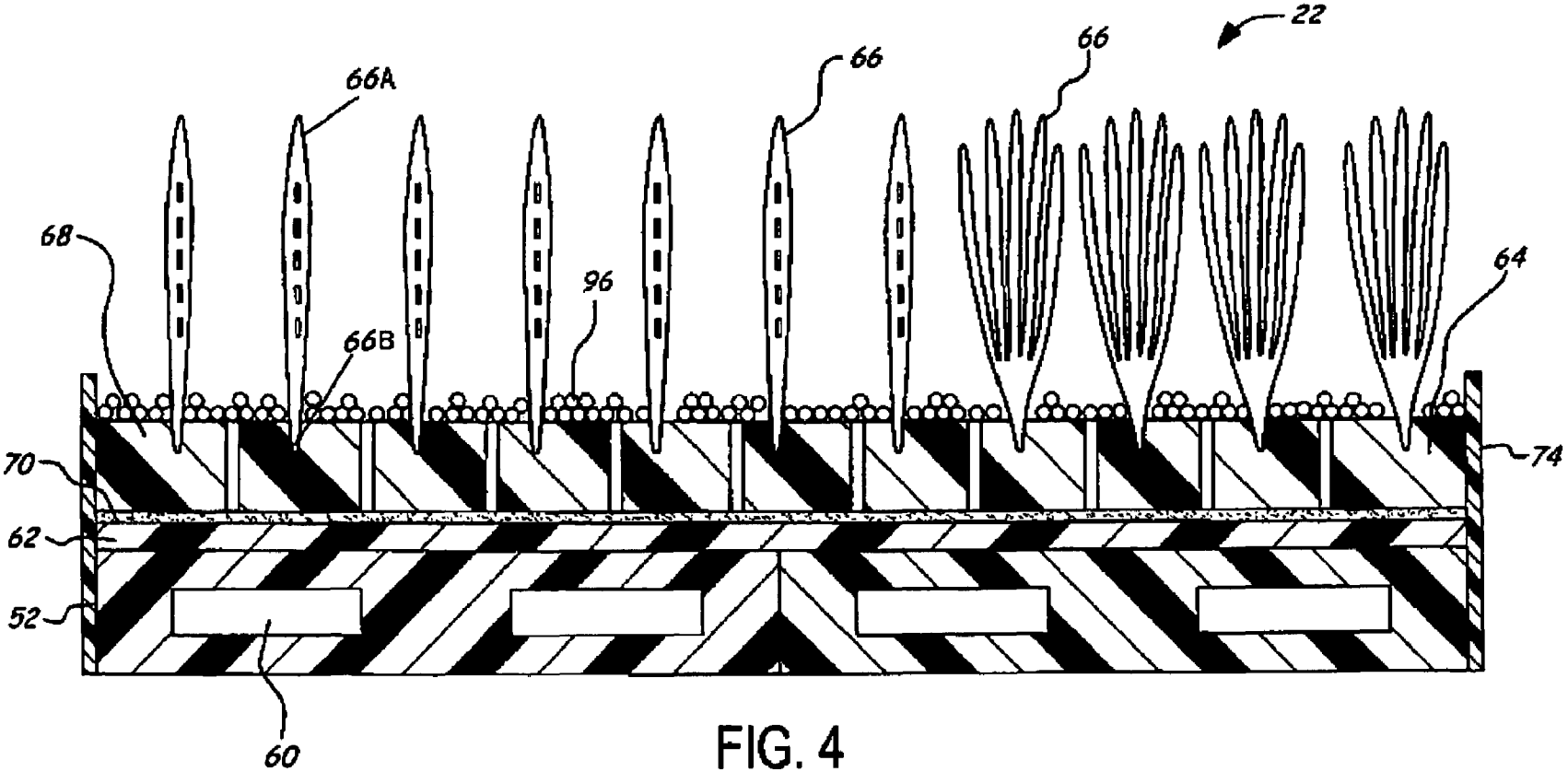
FIG. 4 is a section view of FIG. 3.

After the pallets 52 are fastened together to form the unit 22, as shown in FIGS. 3 and 4, a layer of elastomeric material 62 is introduced to the top surface 54 of the pallets 52. The elastomeric material 62 serves as a cushion for the playing field 20. One preferred elastomeric material 62 is Startrack, a cryogenically ground rubber material mixed with polymers to form a layer. Dougherty Track manufactures Startrack.

A 1-inch by 5-inch wood form is placed around the outer surfaces of the pallet 52 forming the unit 52 for a period of about three days to allow elastomeric material layer 62 to settle onto the surface 54 of the pallets to "relieve" the elastomeric layer. The wood form is then removed.

Next, a synthetic grass surface 64 is adhered on top of the elastomeric material 62 using an adhesive 70. One preferred adhesive is Nordot 346, available from Nordot Industries. In alternative embodiments, the synthetic grass surface may be coupled to the elastomeric material (and also to the underlying pallet) using one of more conventional fasteners with or without the use of an adhesive 70.

The synthetic grass surface 64 has a plurality of fibrillated yarn strands 66 tufted (stitched) through a backing layer 68 in rows separated by a first distance, or gauge.

The strands 66 are preferably fibrillated polyethylene fibers having a blade thickness of about 80–110 microns, a fiber width of about 12 millimeters, and a pile length that varies from 0.5 to 2.5 inches depending upon end use. For football fields, longer pile lengths around 2.5 inches are preferred. For soccer fields, wherein the soccer ball moves generally along the grass surface, shorter pile lengths of about 1.5 inches are generally preferred.

Three preferred strands 66 particularly suited for football fields are Thiolon XPS, Thiolon XP and Thiolon LSR fibrillated polyethylene strands, each available from TC Thiolon USA of Dayton, Tenn. The Thiolon XPS and XP strands do not have as many fibrils as the Thiolon LSR strand, therein producing a thicker, heartier blade when fully fibrillated. One synthetic grass surface 64 utilizing the Thiolon XPE version of the strands is GameDay Grass Xp$^e$, manufactured for General Sports Turf Systems or Rochester, Mich., by TC Thiolon USA of Dayton, Tenn.

In conjunction with pile length, blade thickness, and fiber width, the strands 66 have a certain mass per unit length, or denier, that contributes to the overall plushness and playability of the field. Larger deniers equate to strands 66 having a larger mass per unit length. Thus, where high plushness is desired, such as with sports surface such as football and soccer fields, the strands 66 have a denier of at least 10000, while other non-sports related fields 20 may have deniers of less than 10000. Each of these Thiolon strands described above has a denier of about 10,000 and 100-micron thickness.

The strands 66, when applied to the backing 68 will be configured to lay a particular way on the backing. In other words, the tufting process is performed such that the uppermost ends 66A of the strands 66 lying above the tufted portion 66B will naturally fall substantially in the same direction. The grain of the unit 22 can therefore be classified as "with the grain" or "against the grain", depending upon an observer's relative position. A "with the grain" positioning is thus defined wherein the uppermost end 66A of the strand 66 has fallen in a direction away from a viewer's eye relative to the tufted portion 66B of the strand, while an "against the grain" positioning is defined wherein the uppermost end 80A of the strand 66 falls towards a viewer's eye. The importance of this grain classification will become evident below.

In addition, the strands 66 are stitched into the backing layer 68 at a stitch rate of between about 7 and 24 stitches per 3-inch period. The strands 66 have a gauge of between 1/8 and 1/2 inch, depending upon the end use application of the field. The smaller the gauge, the plusher the field. In addition, a smaller gauge adds additional barriers to prevent the movement of the infill 96 during use and weather conditions such as rainfall and wind, as additional rows of strands 80 physically prevent infill 96 movement.

The stitch pattern of strands 66 within the backing layer 68 may vary depending upon the desired look and plushness. For example, the strands 66 are stitched in a substantially linear pattern, in a "lazy s" pattern, or in a single herringbone or double herringbone pattern. In particular, the single herringbone pattern and the double herringbone pattern are preferable for use on fields having a crown from the center to the sides, in that these patterns help to prevent the overlaid infill 96 from washing away from the center towards the sides during heavy rainstorms.

The gauge, as people of ordinary skill in the carpeting understand, refers to the average distance between rows of fiber strands 66. The smaller the gauge, the more fibers per unit distance, and hence the plusher the field.

The GameDay Grass Xp$^e$, one of the preferred grass surfaces 64 described above, is a 10000 denier grass surface having a 2 and ¾ inch pile height, ⅜ inch gauge, 100 micron fiber thickness, and 12 mm fiber width.

In addition, the grass surface 64 may be tufted with yarn strands 66 having varying colors tufted to form the desired feature 46, such as a logo 38 or number 34. Alternatively, after the individual modular units 22 are formed, the features 46 may be inlaid or stenciled onto the surface.

In the inlaying process, a template is introduced onto the surface 64 of the modular unit 22 at a position determined by laser plotting or some other kind of alignment technique. A cutting utensil is used to cut through the backing layers 68 corresponding to the edges of the stencil within an opening. The cut out portion of the field 64 is removed, therein leaving an opening. An adhesive 100 is then applied within the opening, and a new section of the synthetic grass material 64, colored as desired, corresponding in size to the cut out portion, is then laid onto the adhesive within the opening. A border of a third color may be installed around the new section in substantially the same manner.

In the stenciling process, a template is introduced onto the surface 64 at a position determined by laser plotting or some other kind of alignment technique. A can of spray paint is then sprayed within the opening of the template onto the surface 64. The template is removed and the paint is allowed to dry, therein forming the feature 64. The process may be repeated to introduce a border or to introduce other colors within the painted regions.

The backing material 68 preferably provides dimensional stability to the grass surface 64. One preferred backing material 68 is formed from one or more layers of a double woven polypropylene/polyethylene warp and weft layer. Another preferred backing material 68 is a woven polypropylene/polyethylene layer having a construction polypropylene warp fiber of 94 threads per 10 cm and a construction polyester weft fiber of 63 threads per 10 cm.

A secondary coating is applied to the woven layers of the backing material 68 to seal the strands 66 to the backing layer 68 and to add a layer of dimensional stability to the backing 68. The secondary coating is applied at about 24 to 30 ounces per square foot onto the woven component of the backing material 68.

One preferred backing material 68 is Thiobac™, available from TC Thiolon USA of Dayton, Tenn.

Alternatively, a backing material 68 may be formed from two or more layers of woven backing materials coupled together. A secondary coating is applied to the woven layers to seal the strands 66 to the backing layer 68 and to add a layer of dimensional stability to the backing 68. The secondary coating is applied at about 24 to 30 ounces per square foot onto the backing material 68.

Next, a resilient particle infill 96 is preferably introduced on top of the synthetic grass surface 64 at a thickness commensurate with the pile length of the strands 66 that allows the uppermost end 66A to extend above the thickness of the infill 96. For the football field, the thickness is between approximately 0.5 and 3 inches and has a density of between about 3 and 3.5 pounds per square foot. The resilient particle infill 96 preferably is composed of cryogenically ground vulcanized scrap rubber having a sieve of between approximately 8 and 30, and more preferably between 10 and 15. This rubber is preferably 100 percent recycled post-consumer automobile tires, and therein provides an environmentally friendly use for these products. However, other cryogenically ground vulcanized rubber products that meet the desired specifications may be utilized as the infill 96, alone or in combination with automobile tire rubber. For example, ground rubber recycled rubber may come from certain types of shoes. In addition, other resilient particles, including crumb rubber, cork, or polymer beads, for example, may compose a portion of the resilient particle infill 96.

In addition, and specifically for indoor facilities, a portion or all of cryogenically ground rubber may be replaced by ambiently ground rubber. As those of ordinary skill in the art recognize, however, ambiently ground rubber produces irregular jagged shaped particles that may not be beneficial for sports surfaces. In addition, the process for forming the rubber particles may degrade the rubber due to excess heat buildup. Also, and most relevant in the case of outdoor sports fields, excess heat generated by environmental conditions (the sun and outdoor air temperature) may act to degrade the rubber infill. As such, ambiently ground rubber is not desirable for outdoor sports playing surfaces.

After the infill 96 is introduced, a corrugated plastic sleeve 74 is introduced around the modular unit 22. The sleeve 74 functions to prevent the infill 96 from falling off the modular unit 22 during storage and transportation. To accomplish this, the sleeve 74 extends slightly higher than the top surface of the synthetic grass surface 64.

The sleeve 74 may also be affixed to the modular unit by any number of mechanisms well known in the art. For example, the sleeve 74 could be nailed or screwed to the side of the modular unit 22. Preferably, however, the sleeve 74 substantially conforms to the side surfaces of the modular unit without any affixation.

In alternative embodiments, plusher grass surface may be formed utilizing the so-called knit-to-knit process, in which the shorter strands of polyethylene fibers are tufted in tighter configurations (i.e. smaller gauge). The plushness of grass surfaces utilizing the knit-to-knit process has sufficient resilience that does not require the introduction of a resilient particle infill 96 and corrugated plastic sleeves 74. In this embodiment, an additional layer of resilient padding (not shown) is introduced between the backing material and the elastomeric layer for added bounce.

Figure 5:
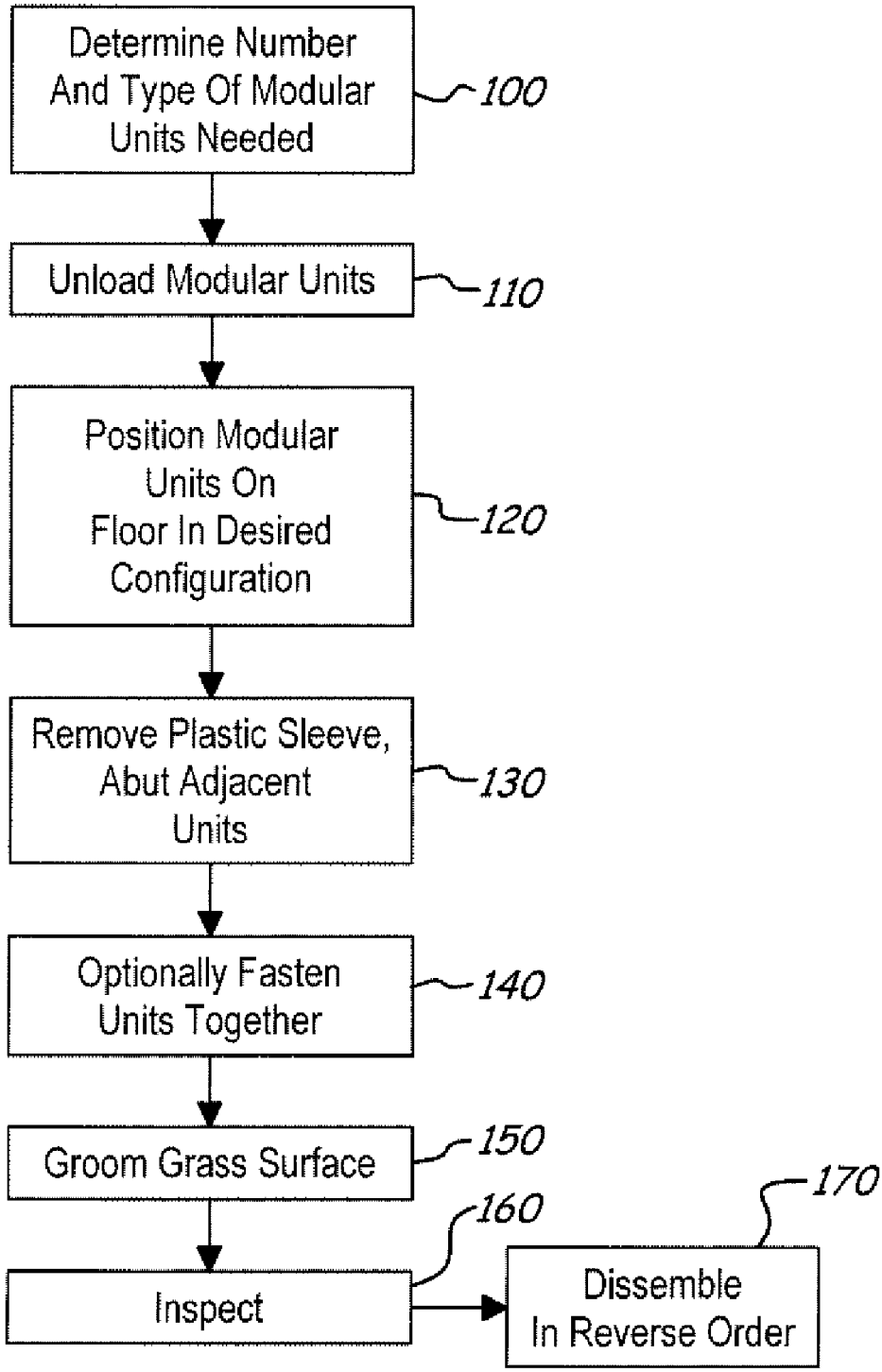
FIG. 5 is a logic flow diagram for assembling and disassembling the sports playing surface as in FIG. 1.

FIG. 5 illustrates a logic flow diagram for assembling and disassembling the sports playing surface 20 from a plurality of modular units 22. Beginning with Step 100, careful measurements are made for the desired length and width of the playing surface to determine the number of modular units 22 needed. For a standard American football field having about 100,000 square feet of playing surface, approximately 1042 modular units, each having about 96.5 square feet of playing surface, are needed. The units 22 are arranged according to any marking they may have along the turf surface 64.

Next, in Step 110, a corresponding number of stacked modular units 22 are unloaded one at a time by placing the forks of a standard forklift within the respective openings 60 in the side of one of the pallets 52.

In Step 120, the units 22 are placed next to each other in the desired configuration (for example, as shown in FIG. 1 with yard lines running straight and logos properly aligned).

In Step 130, the plastic sleeves 74 of each respective placed unit 22, in units having an infill layer 96, are removed and the units 22 moved together with respective side regions of adjacent units 22 substantially abutting one another. In this configuration, the synthetic grass surface 64 of each modular unit 22 is substantially level with respect to the synthetic grass layer 64 of the next adjacent modular unit 22 to form a substantially level playing surface.

In Step 140, the units 22 are optionally fastened together with ⅜-inch all-thread rods with coarse-thread hex nuts and with 5/16-inch washers on top and bottom. This step is optional but preferable, as the units 22 have sufficient weight to prevent shifting during play. A 3.5-inch by 1-inch c-channel may also be introduced through the center of the units 22 to aid in stabilizing the units.

In Step 150, a groomer device is introduced to the playing surface 64 to ensure that the infill 96 is substantially level and evenly distributed across the top surface. A brush may also be applied to the grass strands 66 to ensure complete fibrillation.

In Step 160, the field 20 is inspected to ensure that the playing surface is in a desired playing condition.

To disassemble the field, as shown in Step 170, simply repeat steps 100–140 in reverse order.

The modular concept of the present invention thus allows synthetic turf fields 20 to be easily installed and removed in a fraction of the time and expense typically need in prior art synthetic surfaces as described above. This allows stadiums and venues utilizing such units 20 to be able to potentially schedule more events in any calendar year, therein increasing profitability of the respective venue. The modular units 22 are easily transportable and stackable, therein allowing for efficient and space-limiting storage.

While the invention has been described in terms of preferred embodiments, it will be understood, of course, that the invention is not limited thereto since modifications may be made by those skilled in the art, particularly in light of the foregoing teachings.

The invention claimed is:

1. A method for assembling a modular sports field, the method comprising:

(a) forming a plurality of modular units, each of said plurality of modular units comprising:

a modular base structure comprising a plurality of pallets fastened together;

an elastomeric material coupled to a top side of said modular base structure;

a synthetic turf material layer coupled onto said elastomeric material, said synthetic turf material layer comprising a plurality of fibrillated synthetic grass strands tufted into a backing layer, said fibrillated synthetic grass strands having a first pile length extending from said backing layer, said first pile length being between about 0.5 and 2.5 inches;

an optional adhesive layer between said elastomeric material and said synthetic turf material layer;

a layer of resilient particle infill placed onto said synthetic turf material layer to a first substantially uniform depth, said first substantially uniform depth being less than said first pile length; and a removable plastic sleeve coupled around each modular base structure;

(b) placing at least two of a plurality of modular base structures on a relatively fiat surface in a desired configuration;

(c) removing said removable plastic sleeve from each of said at least two of said plurality of modular base structures;

(d) substantially abutting one of said at least two of said plurality of modular base structures to an adjacent one of said at least two of said plurality of modular base structures such that said synthetic turf material layer of said one of said at least two of said plurality of modular base structures is level with respect to said adjacent one of said at least two of said plurality of modular base structures; and (e) optionally grooming said layer of said resilient particle infill such that the depth of said layer of said resilient particle infill of said one of said at least two of said plurality of modular base structures is level with said adjacent one of said at least two of said plurality of modular base structures.

2. The method of claim 1, wherein said modular base structure comprises a plurality of pallets fastened together in a desired rectangular configuration.

3. The method of claim 1, wherein said elastomeric layer comprises a rubber based elastomeric layer.

4. The method of claim 1, wherein said plurality of fibrillated synthetic grass strands comprises a plurality of fibrillated polyethylene grass strands.

5. The method of claim 1, wherein said synthetic turf material layer is formed utilizing a knit-to-knit process.

6. The method of claim 1, wherein said plurality of fibrillated synthetic grass strands has a denier of at least 10000.

7. The method of claim 1, wherein said backing material comprises one or more layers of a double woven polypropylene backing material.

8. The method of claim 1, wherein said layer of resilient particle mull comprises a layer of cryogenically ground vulcanized rubber infill having an average mesh size of between approximately 8 and 30.

9. The method of claim 1, wherein said layer of resilient particle infill comprises a mixture of a layer of cryogenically ground vulcanized rubber infill having an average mesh size of between approximately 8 and 30 and a second resilient material, said second resilient material being selected from the group consisting of: ambiently ground rubber, crumb rubber, cork, and polymer beads.

10. The method of claim 1 further comprising:

(f) fastening said one of said at least two of said plurality of modular base structures to said adjacent one of said at least two of said plurality of modular base structures prior to step (e).

11. The method of claim 10, wherein (f) fastening said one of said at least two of said plurality of modular base structures to said adjacent one of said at least two of said plurality of modular base structures prior to step (e) comprises utilizing ⅜ inch all-thread rods with coarse-thread hex nuts and 5/16 inch washers.

12. The method of claim 1, wherein (d) substantially abutting one of said at least two of said plurality of modular base structures to an adjacent one comprises:

providing a forklift;

introducing a fork of a forklift within an opening of one of said plurality of pallets comprising said one of said modular base structures;

moving said one of said modular base structures to a desired position on a floor to be covered;

removing said fork from said opening;

introducing said fork within a respective opening of said adjacent one of said modular base structures;

moving said adjacent one of said modular base structures to a position such that a respective side region of each of said one and said adjacent one of said modular base structures substantially abuts and such that said synthetic turf material layer of said one of said at least two of said plurality of modular base structures is level with respect to said synthetic turf material said adjacent one of said at least two of said plurality of modular base structures; and removing said fork from said respective opening of said adjacent one of said modular base structures.

13. The method of claim 12 further comprising (f) disassembling the modular sports field after usage by:

introducing said fork within said opening of said one of said plurality of pallets comprising said one of said modular base structures;

moving said one of said modular base structures from said desired position on said floor to a storage area;

removing said fork from said opening;

inserting said removable plastic sleeve around said one of said modular base structures;

introducing said fork within a respective opening of said adjacent one of said modular base structures;

moving said adjacent one of said modular base structures to said storage area;

removing said fork from said respective opening of said adjacent one of said modular base structures;

introducing another of said plastic sleeves around said adjacent one of said modular base structures;

reintroducing said fork within said respective opening of said adjacent one of said modular base structures;

stacking said adjacent one of said modular base structures onto said one of said modular base structures; and removing said fork from said respective opening of said adjacent one of said modular base structures.

14. The method of claim 1 further comprising inlaying at least one feature within said synthetic turf material layer prior to introducing said layer of resilient particle infill onto said synthetic turf material layer.

15. The method of claim 1 further comprising stenciling at least one feature within said synthetic turf material layer prior to introducing said layer of resilient particle infill onto said synthetic turf material layer.

16. A method for forming a modular unit for use in a synthetic turf sports field, the method comprising:

forming a modular base structure comprising providing a plurality of pallets and fastening together at least two of said plurality of pallets to form said modular base structure having a desired rectangular configuration;

coupling an elastomeric material to a top side of said modular base structure;

optionally applying an adhesive to a first side of said elastomeric material;

coupling a synthetic turf material layer coupled onto said elastomeric material such that said adhesive is between said top side and said synthetic turf material layer, said synthetic turf material layer comprising a plurality of fibrillated synthetic grass strands tufted into a backing layer, said fibrillated synthetic grass strands having a first pile length extending from said backing layer, said first pile length being between about 0.5 and 2.5 inches;

introducing a layer of resilient particle infill onto said synthetic turf material layer to a first substantially uniform depth, said first substantially uniform depth being less than said first pile length; and coupling a plastic sleeve around each modular base structure.

17. The method of claim 16, wherein fastening together at least two of said pallets comprises:

(a) fastening one of said plurality of pallets to an adjacent one of said plurality of pallets utilizing ⅜ inch all-thread rods with coarse-thread hex nuts and 5/16 inch washers;

(b) repeating step (a) for each additional one of said plurality of pallets.

18. The method of claim 16 further comprising inlaying at least one feature within said synthetic turf material layer prior to introducing said layer of resilient particle infill onto said synthetic turf material layer.

19. The method of claim 16 further comprising stenciling at least one feature within said synthetic turf material layer prior to introducing said layer of resilient particle infill onto said synthetic turf material layer.

20. The method of claim 16 further comprising fastening said elastomeric layer to said synthetic turf material layer using at least one mechanical fastener.

* * * * *

UNITED STATES PATENT AND TRADEMARK OFFICE

CERTIFICATE OF CORRECTION

PATENT NO. : 7,155,796 B2
APPLICATION NO. : 10/709206
DATED : January 2, 2007
INVENTOR(S) : Charles Cook It is certified that error appears in the above-identified patent and that said Letters Patent is hereby corrected as shown below:

In The Claims:

Claim 1
Column 7, Line 61, should read as follows: -- structures on a relatively flat surface in a desired --

Claim 8
Column 8, Line 30, should read as follows: -- particle infill comprises a layer of cryogenically ground --

Claim 17
Column 10, Line 24, should read as follows: -- one of said plurality of pallets utilizing 3/8 inch all- --

Signed and Sealed this

Twenty-seventh Day of February, 2007

JON W. DUDAS
*Director of the United States Patent and Trademark Office*